US009472897B2

(12) United States Patent
Kato et al.

(10) Patent No.: US 9,472,897 B2
(45) Date of Patent: Oct. 18, 2016

(54) CONNECTOR

(71) Applicant: Yazaki Corporation, Tokyo (JP)

(72) Inventors: Hajime Kato, Kakegawa (JP); Miki Nakamura, Kakegawa (JP); Yoshitake Ohmori, Kakegawa (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 14/689,281

(22) Filed: Apr. 17, 2015

(65) Prior Publication Data

US 2015/0222054 A1 Aug. 6, 2015

Related U.S. Application Data

(63) Continuation of application No. PCT/JP2013/080088, filed on Nov. 7, 2013.

(30) Foreign Application Priority Data

Nov. 7, 2012 (JP) ..... 2012-245646

(51) Int. Cl.

| | |
|---|---|
| ***H01R 13/625*** | (2006.01) |
| ***H01R 13/631*** | (2006.01) |
| ***H01R 13/71*** | (2006.01) |
| ***H01R 35/04*** | (2006.01) |

(Continued)

(52) U.S. Cl.

CPC ..... *H01R 13/631* (2013.01); *H01R 13/71* (2013.01); *H01R 35/04* (2013.01); *H01R 13/629* (2013.01); *H01R 2105/00* (2013.01); *H01R 2201/26* (2013.01)

(58) Field of Classification Search

CPC .... H01R 13/15; H01R 13/22; H01R 13/629; H01R 13/193; H01R 13/631

USPC ..... 439/338, 341, 376

See application file for complete search history.

(56) References Cited

U.S. PATENT DOCUMENTS

| | | | | |
|---|---|---|---|---|
| 3,617,985 A * | 11/1971 | Kehl | ..... | H01R 23/10 439/341 |
| 4,179,180 A * | 12/1979 | Hanna | ..... | H01R 13/71 439/102 |
| 5,104,331 A * | 4/1992 | Goble | ..... | H01R 35/04 439/341 |

(Continued)

FOREIGN PATENT DOCUMENTS

| | | |
|---|---|---|
| DE | 323367 A | 7/1920 |
| DE | 2902192 A1 | 7/1980 |

(Continued)

OTHER PUBLICATIONS

Written Opinion dated Feb. 10, 2014 issued by the International Searching Authority in counterpart International Application No. PCT/JP2013/080088 (PCT/ISA/237).

(Continued)

*Primary Examiner* — Hien Vu

(74) *Attorney, Agent, or Firm* — Sughrue Mion, PLLC

(57) ABSTRACT

A connector has a male-side housing provided with terminals and a female-side housing provided with contact portions to contact the terminals. In a state in which the male-side housing and the female-side housing are rotated relative to each other and engaged with each other, the terminals and the contact portions are contact each other to be electrically connected.

5 Claims, 3 Drawing Sheets

(51) Int. Cl.
*H01R 13/629* (2006.01)
*H01R 105/00* (2006.01)

(56) References Cited

U.S. PATENT DOCUMENTS

| | | | | |
|---|---|---|---|---|
| 5,476,392 | A * | 12/1995 | Inaba | B60L 3/00 439/341 |
| 6,422,888 | B1 * | 7/2002 | Goble | H01R 13/62933 439/341 |
| 7,165,995 | B2 | 1/2007 | Fukushima et al. | |
| 2005/0174765 | A1 | 8/2005 | Dorleijn et al. | |
| 2005/0191904 | A1 | 9/2005 | Fukushima et al. | |
| 2014/0017948 | A1 | 1/2014 | Hara et al. | |
| 2014/0056009 | A1 | 2/2014 | Swedberg et al. | |
| 2015/0118879 | A1 | 4/2015 | Swedberg et al. | |

FOREIGN PATENT DOCUMENTS

| | | | |
|---|---|---|---|
| DE | 8504602 | U1 | 6/1986 |
| DE | 2 400 987 | A | 10/2004 |
| DE | 11 2013 004 192 | T5 | 5/2015 |
| EP | 1 343 226 | A2 | 10/2003 |
| JP | S57-104477 | U1 | 6/1982 |
| JP | 2003-257571 | A | 9/2003 |
| JP | 2005-235424 | A | 9/2005 |
| JP | 2011-90999 | A | 5/2011 |
| JP | 2012-64331 | A | 3/2012 |
| JP | 2012-195142 | A | 10/2012 |

OTHER PUBLICATIONS

International Search Report dated Feb. 10, 2014 issued in counterpart International Application No. PCT/JP2013/080088 (PCT/ISA/210).
Office Action dated Jun. 7, 2016 issued by the Japanese Patent Office in counterpart Japanese Patent Application No. 2012-245646.
Office Action dated Jul. 21, 2016 issued by the German Patent Office in counterpart German Patent Application No. 11 2013 005 320.9.

* cited by examiner

CONNECTOR

CROSS REFERENCE TO RELATED APPLICATIONS

This application is a continuation of International Patent Application No. PCT/JP2013/080088 filed on Nov. 7, 2013, claiming priority from Japanese Patent Application No. 2012-245646 filed on Nov. 7, 2012, the contents of which are incorporated herein by reference.

FIELD OF INVENTION

The present invention relates to the structure of a connector for connecting a terminal.

BACKGROUND ART

In vehicles such as cars, various kinds of connectors for connecting terminals are used to connect an electric circuit formed between in-vehicle electric components (see Patent Document 1 and Patent Document 2).

Patent Document 1 discloses a structure example of a connector where a member holding female terminals (female terminal housing) and a member holding male terminals (male terminal housing) to be connected to the female terminals are configured as separate members. In such a connector, when connecting the female terminals and the male terminals to each other, connection ports of the female terminal housing and the male terminal housing are placed so as to be opposed to each other, and then, pressing force (insertion force) is applied on these housings to insert the male terminals into the female terminals.

Patent Document 2 discloses a structure example of a connector that interconnects electric wire side terminals fixed to the terminal portions of electric wires and device side terminals provided on a device to which the electric wires are to be connected. On the electric wire side terminals and the device side terminals, bolt holes that can communicate with each other are formed. In such a connector, when connecting the electric wire side terminals and the device side terminals to each other, the electric wire side terminals are placed on the device side terminals so that the bolt holes of both terminals are disposed to communicate with each other, and bolts inserted through the bolt holes are fastened by nuts.

Patent Document 1: JP2005-235424A

Patent Document 2: JP2012-64331A

In the connector disclosed in Patent Document 1, in connecting the female terminal and the male terminal, it is necessary to apply insertion force on the female terminal housing and the male terminal housing, that is, on the female terminals and the male terminals. In this case, if the number of female terminals and male terminals to be connected is small, the insertion force necessary for their connection is comparatively small. However, in the case of a connector having a number of female terminals and male terminals, these terminals are connected simultaneously, a large insertion force is required accordingly, and this can lead to an increase in workload.

In the connector disclosed in Patent Document 2, in connecting the electric wire side terminals and the device side terminals, it is necessary to perform fastening work using bolts and nuts, so that increase in work process is unavoidable. To perform such fastening work, it is necessary to provide an opening or the like for inserting a work tool or the like into the connector. If such an opening is provided, the size of the body of the connector increases accordingly.

SUMMARY OF INVENTION

The present invention is made in view of the circumstances described above, and an object thereof is to provide a connector that can downsize its body and can reduce terminal connecting workload.

To solve the problem described above, according to an aspect of the present invention, a connector is provided. The connector has a male-side housing provided with terminals and a female-side housing provided with contact portions to contact the terminals. The terminals and the contact portions contact each other to be electrically connected in a state in which the male-side housing and the female-side housing are rotated relative to each other to and engaged with each other. The terminals include a first terminal and a second terminal, the first terminal being provided to protrude toward the contact portions as a rotation axis of the relative rotation of the male-side housing and the female-side housing. The contact portions include a first contact portion into which the first terminal is inserted in a rotatable manner and a second contact portion in which the second terminal is fitted. The female-side housings is formed with a fitting groove configured to guide the second terminal to rotate about the first terminal during the rotation relative to the male-side housing and to fit the second terminal in the second contact portion.

According to this, only by rotating the male-side housing and the female-side housing relative to each other so as to be engaged with each other, the terminals (the first terminal and the second terminal) and the contact portions (the first contact portion and the second contact portion) are brought into contact with each other, so that the terminals and the contact portions are electrically connected to each other. Consequently, force to be applied for connecting the terminals and the contact portions can be reduced. Moreover, in connecting the terminals and the contact portions, for example, fastening work using bolts and nuts is unnecessary, the work process is not increased, and it is also unnecessary to provide an opening or the like for inserting a work tool or the like into the connector. For this reason, it is not required to increase the body size of the connector, so that downsizing can be achieved.

According to another aspect of the present invention, provided is a connector in which at least two of the second terminals and at least two of the second contact portions are provided.

According to another aspect of the present invention, provided is a connector in which distances from a center axis of the first terminal to the second terminals are different from each other. This provides a structure in which each of the second terminals can contact only the individually corresponding contact portion (second contact portions), respectively, so that if it is tried to connect the second terminals and the contact portions in wrong combination, the connection is prevented. Consequently, mis-contact therebetween can be prevented in a reliable manner.

According to another aspect of the present invention, provided is a connector in which the second terminals are opposed to each other in a pair across the first terminal, the fitting grooves are formed in a pair corresponding to the pair of second terminals, and a distance from a rotation start position of one of the second terminals to a fitting start position of the one of the second terminals fitting in one of the fitting grooves and a distance from a rotation start position of the other second terminal to a fitting start position of the other second terminal fitting in the other fitting groove are different from each other. Accordingly, the time at which the one of the second terminals enters the one of the fitting grooves (the fitting start timing) and the time at which the other second terminal enters the other fitting groove (the fitting start timing) can be shifted, so that the timings at which they enter (the fitting start timings) do not coincide with each other. Consequently, the peak of the rotation force during the relative rotation of the male-side housing and the female-side housing for their engagement can be distributed, so that the rotation force at the peak can be reduced.

According to the present invention, it is possible to provide a connector that can downsize its body and can reduce terminal connecting workload.

EMBODIMENTS OF INVENTION

First Embodiment

Figure 1A:
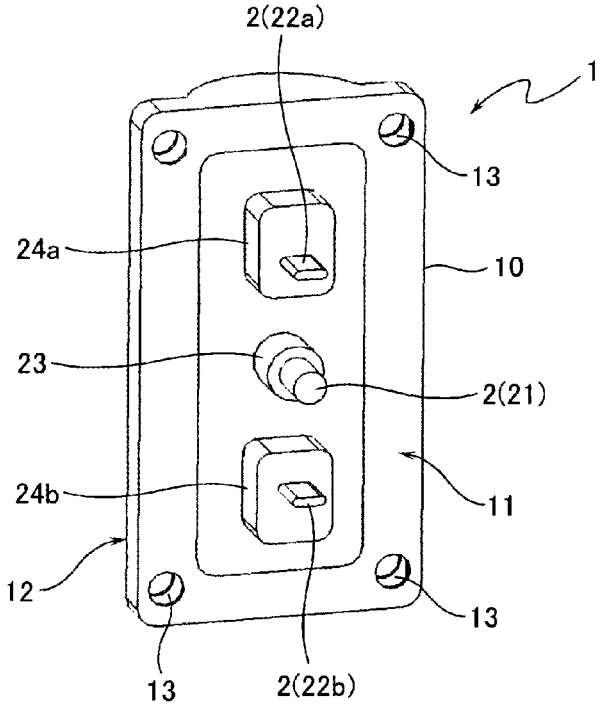
FIGS. 1A and 1B are views showing an overall structure of a connector according to an embodiment of the present invention, FIG. 1A being a perspective view showing a structure of one connector housing (a male-side housing) forming a pair, and FIG. 1B being a perspective view showing a structure of the other connector housing (a female-side housing).
Figure 1B:
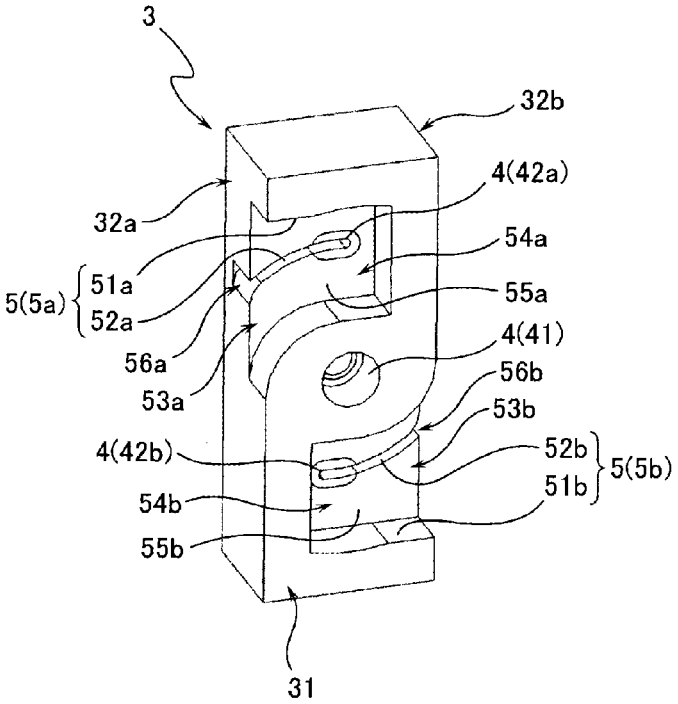
Figure 2A:
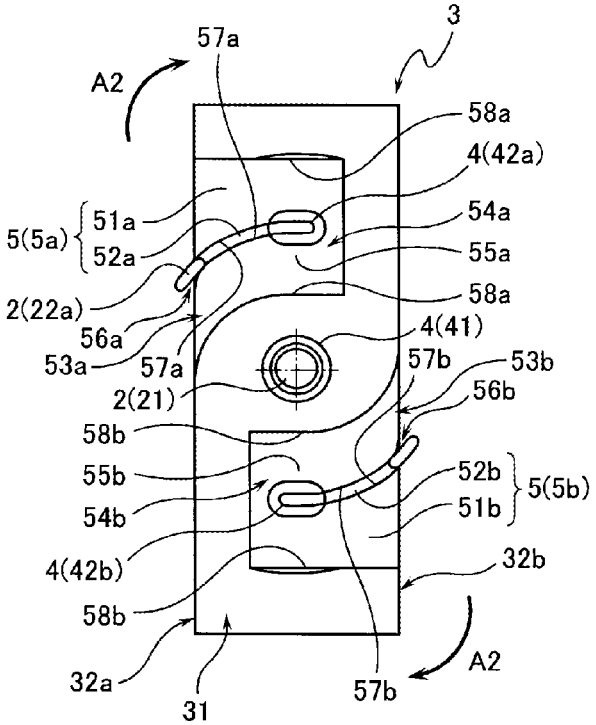
FIGS. 2A and 2B are views schematically showing a rotation of terminals (second terminals) when engaging a male-side housing and a female-side housing of a connector according to a first embodiment of the present invention, FIG. 2A being a schematic view showing a state at the time of starting the rotation, and FIG. 2B being a schematic view showing a state at the time when the rotation is stopped (when the terminals have been connected).
Figure 2B:
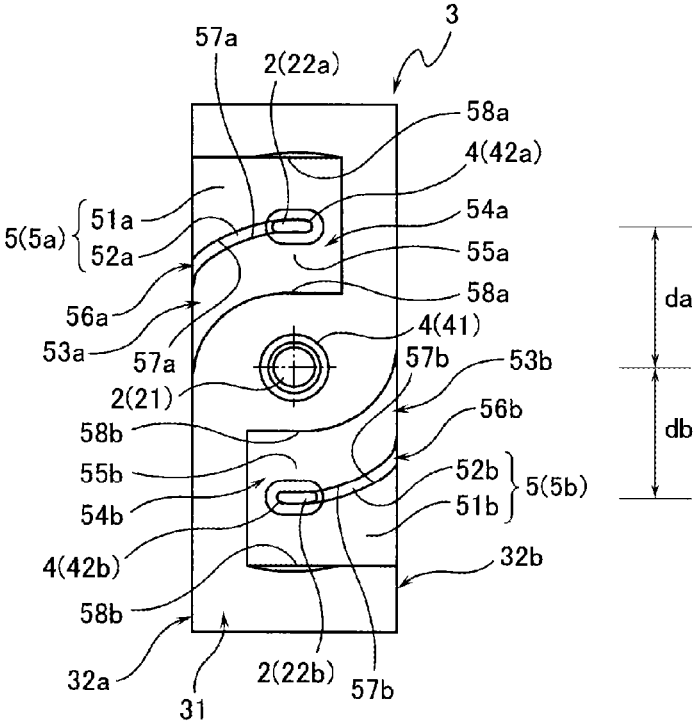

Hereinafter, a connector according to the present invention will be described with reference to the attached drawings. FIGS. 1A and 1B are views showing an overall structure of a connector according to an embodiment of the present invention, FIG. 1A being a perspective view showing a structure of one connector housing (a male-side housing) forming a pair, and FIG. 1B being a perspective view showing a structure of the other connector housing (a female-side housing). FIGS. 2A and 2B are views schematically showing a rotation of terminals (second terminals which will be described later) when engaging a male-side housing and a female-side housing of the connector according to a first embodiment of the present invention, FIG. 2A being a schematic view showing a state at the time of starting the rotation, and FIG. 2B being a schematic view showing a state at the time when the rotation is stopped (when the terminals have been connected).

As shown in FIG. 1, the connector has the male-side housing 1 having terminals 2 and the female-side housing 3 having contact portions 4 to contact the terminals 2. When the male-side housing 1 and the female-side housing 3 are rotated relative to each other and engaged with each other, the terminals 2 and the contact portions 4 contact with each other to be electrically connected. As described above, the connector is a connection member for electrically connecting the terminals 2 and the contact portions 4. The connector according to the present invention is an interface for connecting and disconnecting a given electric circuit by the connection of the terminals 2, and its use is not specifically limited. For example, it may be used for an in-wheel motor mounted on vehicles such as electric cars driven using an electric motor and hybrid cars driven by using both an engine and an electric motor. Specifically, it may be applied to cases such as when connecting and disconnecting a high voltage electric circuit that supplies power to the in-wheel motor.

The male-side housing 1 has a shell 10 as a base member for disposing the terminals 2. In FIG. 1A, the structure of the plate-like shell 10 molded so that the general shape is substantially rectangular is shown as an example. The general shape of the shell 10 is not limited thereto. The shell 10 is structured so that a flat surface 11 on one side is a surface to be opposed to the female-side housing 3 and a flat surface 12 on the other side is a surface for connection to a terminal portion of a shielding member (not shown). In the four corners of the shell 10, through holes 13 passing through from the flat surface 11 to the flat surface 12 are formed. By the bolts inserted in these through holes 13, the male-side housing 1 is fastened to a member to which the male-side housing 1 is to be attached (for example, an attachment surface of the shielding member (not shown)). The shell 10 is provided with the terminals 2 protruding from the flat surface 11.

The terminals 2 include a first terminal 21 provided to protrude toward the contact portion 4 as a rotation axis of the relative rotation of the male-side housing 1 and the female-side housing 3, and at least two second terminals 22*a*, 22*b* provided in a protruding manner so as to be opposed to each other across the first terminal 21. As an example, in the present embodiment, the two second terminals 22*a*, 22*b* forming a pair and opposed to each other across the first terminal 21 are provided. In the case of this structure, for example, by setting a ground for the first terminal 21, the generation of an arc can be suppressed. In the present invention, the positions where the second terminals 22*a*, 22*b* are provided in a protruding manner are not limited to the ones where they are opposed to each other across the first terminal 21. The number of second terminals may be one, and when the number of second terminals is two, they may be provided in a protruding manner so that the first terminal 21 is not situated between them.

The first terminal 21 is provided in a condition cylindrically protruding from a first base portion 23 provided in such a way as to upheave the flat surface 11. That is, the first terminal 21 is structured as a cylindrical protrusion on the first base portion 23. The second terminals 22*a*, 22*b* are both provided in a protruding manner so as to be curved in an arc shape (So-called R shape. This R shape is a circle where the first terminal 21 is the center axis and the distance from the first terminal 21 to the second terminals 22*a*, 22*b* is the radius) from second base portions 24*a*, 24*b* provided in such a way as to upheave the flat surface 11. That is, the second terminals 22*a*, 22*b* are structured as arc-shaped protrusions on the second base portions 24*a*, 24*b*. In that case, these second terminals 22*a*, 22*b* are disposed so that the concaved side curved parts of the arc-shaped protrusions are opposed to each other. The first base portion 23 is concentric with the first terminal 21 and upheaved from the flat surface 11 in the shape of a cylinder having a larger diameter than the first terminal 21. On the other hand, the second base portions 24*a*, 24*b* are upheaved from the flat surface 11 in the same substantially rectangular parallelepiped shape.

The second terminals 22*a*, 22*b* are disposed so as to be aligned on a straight line passing through the center axis (the center point) of the first terminal 21 and along the longitudinal direction of the shell 10 (see FIG. 2B). In the present embodiment, the distances of the second terminals 22*a*, 22*b* from the center axis of the first terminal 21 are different from each other. According to an exemplary structure shown in FIGS. 2A and 2B, the distance from the second terminal 22*a* to the center axis of the first terminal 21 (the distance da shown in FIG. 2B) is larger than the distance from the second terminal 22*b* to the center axis of the first terminal 21 (the distance db shown in FIG. 2B) (da>db). Alternatively, the second terminal 22*a* and the second terminal 22*b* arranged such that the distance from the second terminal 22*a* to the center axis of the first terminal 21 is smaller than the distance from the second terminal 22*b* to the center axis of the first terminal 21. This provides a structure in which each of the second terminal 22*a* and the second terminal 22*b* can contact only the individually corresponding contact portion 4 (a second contact portion 42*a* and a second contact portion 42*b* described later), so that mis-contact can be prevented in a reliable manner. The second terminals 22*a*, 22*b* may be arranged such that the distances to the center axis of the first terminal 21 are the same (a structure where they are equally disposed across the first terminal 21 in between). While the two second terminals 22*a*, 22*b* are provided in a protruding manner for the female-side housing 3 in the present embodiment, a structure may be adopted where three or more second terminals are provided in a protruding manner. In this case, it is preferable to provide an even number of second terminals in a pair so that they are opposed to each other across the first terminal 21.

The female-side housing 3 is a base member for disposing the contact portions 4 to be brought into contact with the terminals 2 (the first terminal 21 and the second terminals 22*a*, 22*b*). In FIG. 1B, the structure of the female-side housing 3 the general shape of which is a substantially rectangular parallelepiped is shown as an example. The general shape of the female-side housing 3 is not limited thereto. On the female-side housing 3, three contact portions 4 are provided corresponding to the first terminal 21 and the second terminals 22*a*, 22*b* on a surface 31 opposed to the flat surface 11 of the male-side housing 1.

The contact portions 4 include a first contact portion 41 in which the first terminal 21 is inserted in a rotatable manner and at least two second contact portions 42*a*, 42*b* in which the second terminals 22*a*, 22*b* are fitted. As an example, the present embodiment adopts a structure where the two second contact portions 42*a*, 42*b* are formed corresponding to the two second terminals 22*a*, 22*b* forming a pair and opposed to each other across the first terminal 21. The mode (size, configuration, number, arrangement, etc.) of the contact portions 4 is not specifically limited as long as they correspond to the terminals 2, and may be set arbitrarily.

The first contact portion 41 has a structure where part of the opposed surface 31 is recessed in the shape of a two-step cylinder. That is, the first contact portion 41 is formed as a two-step circular hole. The diameter of the circular hole part of the first step (the side of the opposed surface 31) is set to be slightly larger than the outside diameter of the first base portion 23, and the depth thereof is set to be substantially the same as the height of the upheaval of the first base portion 23 from the flat surface 11. The diameter of the circular hole part of the second step is set to be slightly larger than the outside diameter of the first terminal 21, and the depth thereof is set to be substantially the same as the height of the protrusion of the first terminal 21 from the first base portion 23. Thereby, the first terminal 21 and the first base portion 23 can be inserted into the first contact portion 41, and the inserted first terminal 21 can be rotated relative to the first contact portion 41. In other words, the male-side housing 1 and the female-side housing 3 can be relatively rotated with the first terminal 21 serving as the axis of relative rotation. In that case, the first base portion 23 is also rotated relative to the first contact portion 41, and serves as the axis relative rotation. Here, the first contact portion 41 is a circular hole having a bottom portion, but it may alternatively be configured as a circular hole having no bottom portion (a through hole).

The second contact portions 42*a*, 42*b* have a structure where the opposed surface 31 is partly recessed so as to be curved in an arc shape. The second contact portions 42*a*, 42*b* are formed as holes curved in an arc shape (arc-shaped holes) slightly larger (the outside diameters are large and the inside diameters are small) than the second terminals 22*a*, 22*b*. Thereby, the second terminal 22*a* can be fitted in the second contact portion 42*a*, and the second terminal 22*b* can be fitted in the second contact portion 42*b*. In that case, the second terminals 22*a*, 22*b* and the second contact portions 42*a*, 42*b* can make surface-to-surface contact with each other, and stable contact pressures and contact areas can be ensured between them. Around the second contact portions 42*a*, 42*b*, contact members (for example, metal pieces) for more reliable contact with the second terminals 22*a*, 22*b* may be attached. While a case where the second contact portions 42*a*, 42*b* are arc-shaped holes having a bottom will be described, they may be formed as arc-shaped holes having no bottom (through holes). These second contact portions 42*a*, 42*b* are continuous with fitting grooves 5 (arc-shaped curved grooves) described later.

On the female-side housing 3, the fitting grooves 5 are formed that guide the second terminals 22*a*, 22*b* so as to rotate about the first terminal 21 and fit the second terminals 22*a*, 22*b* into the second contact portions 42*a*, 42*b* at the time of the rotation relative to the male-side housing 1. That is, the second terminals 22*a*, 22*b* are moved by being guided by the fitting grooves 5, and fitted into the second contact portions 42*a*, 42*b* at the end portions of the fitting grooves 5. In that case, the second base portions 24*a*, 24*b* are rotated around the first terminal 21 along the fitting grooves 5 together with the second terminals 22*a*, 22*b*. On the female-side housing 3, two fitting grooves 5*a*, 5*b* are formed corresponding to the second terminals 22*a*. 22*b* on the opposed surface 31. These two fitting grooves 5*a*, 5*b* have pedestal fitting grooves 51*a*, 51*b* and terminal fitting grooves 52*a*, 52*b*.

The pedestal fitting grooves 51*a*, 51*b* are formed in such a manner that the opposed surface 31 is recessed corresponding to the second base portions 24*a*, 24*b*. In the pedestal fitting grooves 51*a*, 51*b*, fitting ports (hereinafter, referred to as pedestal fitting ports) 53*a*, 53*b* of the second base portions 24*a*, 24*b* rotated around the first terminal 21 when the male-side housing 1 and the female-side housing 3 are rotated relative to each other are open at side surfaces 32*a*, 32*b* of the female-side housing 3. The pedestal fitting port 53*a* of the pedestal fitting groove 51*a* is open at the side surface 32*a* of the female-side housing 3, and when the male-side housing 1 and the female-side housing 3 are rotated relative to each other, the second base portion 24*a* enters the pedestal fitting groove 51*a*. On the contrary, the pedestal fitting port 53*b* of the pedestal fitting groove 51*b* is open at the side surface 32*b* of the female-side housing 3, and when the male-side housing 1 and the female-side housing 3 are rotated relative to each other, the second base portion 24*b* enters the pedestal fitting groove 51*b*. These pedestal fitting ports 53*a*, 53*b* are open at the side surfaces 32*a*, 32*b*, respectively, so as to be point-symmetric with respect to the center axis of the first contact portion 41.

The pedestal fitting ports 53*a*, 53*b* are formed so as to be arc-shaped (so-called R-shaped) on the side close to the first contact portion 41 (on the inner radius side when the male-side housing 1 and the female-side housing 3 are rotated relative to each other). Thereby, the second base portions 24*a*, 24*b* can be smoothly guided to the pedestal fitting ports 53*a*, 53*b* when they are rotated.

The pedestal fitting grooves 51*a*, 51*b* have pedestal accommodation portions 54*a*, 54*b* continuous from the pedestal fitting ports 53*a*, 53*b* and extending in the direction of relative rotation of the male-side housing 1 and the female-side housing 3. That is, the pedestal fitting grooves 51*a*, 51*b* are structured so as to communicate with the pedestal accommodation portions 54*a*, 54*b* at the end portions. The pedestal accommodation portions 54*a*, 54*b* are formed by recessing the opposed surface 31 in a substantially rectangular parallelepiped shape a size larger than the second base portions 24*a*, 24*b*. Thereby, the rotated second base portions 24*a*, 24*b* can be accommodated in the pedestal accommodation portions 54*a*, 54*b* at the end portions of the pedestal fitting grooves 51*a*, 51*b*.

The terminal fitting grooves 52*a*, 52*b* are formed so as to be recessed in such a manner that groove bottoms 55*a* and 55*b* of the pedestal fitting grooves 51*a*, 51*b* are curved in an arc shape (So-called R shape. This R shape is a circle where the first contact portion 41 is the center axis and the distance from the first contact portion 41 to the terminal fitting grooves 52*a*, 52*b* is the radius) in accordance with the movement loci of the second terminals 22*a*, 22*b*. That is, the terminal fitting grooves 52*a*, 52*b* form two-step grooves (that is, the fitting grooves 5 (5*a*, 5*b*)) corresponding to the second terminals 22*a*, 22*b* and the second base portions 24*a*, 24*b* together with the pedestal fitting grooves 51*a*, 51*b* corresponding to the second base portions 24*a*, 24*b*. In this case, the terminal fitting grooves 52*a*, 52*b* are formed as grooves (arc-shaped grooves) curved in an arc shape slightly larger (the outside diameters are large and the inside diameters are small) than the second terminals 22*a*, 22*b*. That is, the opposed distance of a groove wall 57*a* of the terminal fitting groove 52*a* and the opposed distance of a groove wall 57*b* of the terminal fitting groove 52*b* are set to be slightly larger than the material thickness (the dimensional difference between the outside and inside diameters) of the second terminals 22*a*, 22*b*. In the terminal fitting grooves 52*a*, 52*b*, fitting ports (hereinafter, referred to as terminal fitting ports) 56*a*, 56*b* of the second terminals 22*a*, 22*b* rotated around the first terminal 21 when the male-side housing 1 and the female-side housing 3 are rotated relative to each other are open at the side surfaces 32*a*, 32*b* of the female-side housing 3. Specifically, the terminal fitting port 56*a* of the terminal fitting groove 52*a* is open at the side surface 32*a* of the female-side housing 3, and when the male-side housing 1 and the female-side housing 3 are rotated relative to each other, the second terminal 22*a* enters the terminal fitting groove 52*a*. On the contrary, the terminal fitting port 56*b* of the terminal fitting groove 52*b* is open at the side surface 32*b* of the female-side housing 3, and when the male-side housing 1 and the female-side housing 3 are rotated relative to each other, the second terminal 22*b* enters the terminal fitting groove 52*b*. These terminal fitting ports 56*a*, 56*b* are open at the side surfaces 32*a*, 32*b*, respectively, so as to be point-symmetric with respect to the center axis of the first contact portion 41.

Moreover, the terminal fitting grooves 52*a*, 52*b* extend continuously from the terminal fitting ports 56*a*, 56*b* in the direction of relative rotation of the male-side housing 1 and the female-side housing 3 so as to be curved in an arc shape, and communicate with the second contact portions 42*a*, 42*b* at the end portions thereof. Thereby, the rotated second terminals 22*a*, 22*b* can be fitted into the second contact portions 42*a*, 42*b* at the end portions of the terminal fitting groove 52*a*, 52*b*. In other words, the male-side housing 1 and the female-side housing 3 can be engaged with each other. Consequently, the second terminals 22*a*, 22*b* and the second contact portions 42*a*, 42*b* are brought into contact with each other and can be electrically connected.

Now, an example will be shown of the procedure performed when the male-side housing 1 and the female-side housing 3 are rotated relative to each other and are engaged with each other and the terminals 2 (the first terminal 21 and the second terminals 22*a*, 22*b*) and the contact portions 4 (the first contact portion 41 and the second contact portions 42*a*, 42*b*) are brought into contact with each other to be electrically connected.

In this case, the male-side housing 1 and the female-side housing 3 are situated so that the flat surface 11 and the opposed surface 31 are opposed to each other. In that case, the male-side housing 1 and the female-side housing 3 are inclined in the direction of relative rotation so that the first terminal 21 is opposed to the first contact portion 41 face-to-face and that the second terminals 22*a*, 22*b* are situated on the front side of the terminal fitting ports 56*a*, 56*b* of the terminal fitting grooves 52*a*, 52*b* (see FIG. 2A). In FIG. 2A, the condition where the male-side housing 1 is inclined leftward (counterclockwise) around the first terminal 21 with respect to the female-side housing 3 is schematically shown by the positions of the second terminals 22*a*, 22*b*.

From this condition, the first terminal 21 is inserted into the first contact portion 41. Under the condition where the first terminal 21 is inserted in the first contact portion 41, the first base portion 23 is also inserted in the first contact portion 41 and the second terminals 22*a*, 22*b* are opposed to the terminal fitting ports 56*a*, 56*b* face-to-face on the front side of the terminal fitting ports 56*a*, 56*b*.

Then, the male-side housing 1 and the female-side housing 3 are rotated relative to each other with the first terminal 21 inserted in the first contact portion 41 as the axis of relative rotation. In this case, as an example, a force that rotates the second terminals 22*a*, 22*b* in the direction A2 shown in FIG. 2A (hereinafter, rotation force) is applied to the male-side housing 1, so that the male-side housing 1 is rotated with respect to the female-side housing 3. Thereby, the second terminals 22*a*, 22*b* enter the terminal fitting grooves 52*a*, 52*b* through the terminal fitting ports 56*a*, 56*b*, and are guided by the terminal fitting grooves 52*a*, 52*b* while sliding on the groove walls 57*a*, 57*b*. In that case, at the same time, the second base portions 24*a*, 24*b* enter the pedestal fitting ports 53*a*, 53*b* of the pedestal fitting grooves 51*a*, 51*b*, and are guided by the pedestal fitting grooves 51*a*, 51*b* while sliding on groove walls 58*a*, 58*b*.

The rotation force is further kept applied under this condition, and the second terminals 22*a*, 22*b* are rotated to the end portions of the terminal fitting grooves 52*a*, 52*b* (the second contact portions 42*a*, 42*b*). Under a condition where the second terminals 22*a*, 22*b* are rotated up to the end portions (the second contact portions 42*a*, 42*b*) of the terminal fitting grooves 52*a*, 52*b*, the second base portions 24*a*, 24*b* are accommodated in the pedestal accommodation portions 54*a*, 54*b* at the end portions of the pedestal fitting grooves 51*a*, 51*b*.

Under this condition, the second terminals 22*a*, 22*b* are fitted in the second contact portions 42*a*, 42*b* at the end portions of the terminal fitting grooves 52*a*, 52*b* (the condition shown in FIG. 2B). Thereby, the second terminals 22*a*, 22*b* and the second contact portions 42*a*, 42*b* can be in contact with each other, so that the second terminals 22*a*, 22*b* and the second contact portions 42*a*, 42*b* can be electrically connected. In FIG. 2B, the condition where the male-side housing 1 is rotated around the first terminal 21 with respect to the female-side housing 3 and the flat surface 11 and the opposed surface 31 are opposed to each other face-to-face is schematically shown by the positions of the second terminals 22*a*, 22*b*. To shut off the electrical connection between the second terminals 22*a*, 22*b* and the second contact portions 42*a*, 42*b*, predetermined work is performed by a procedure opposite to the above-described one performed at the time of connection.

Second Embodiment

In the connector according to the first embodiment described above (FIGS. 1A to 2B), when the male-side housing 1 and the female-side housing 3 are rotated relative to each other and engaged with each other, the fitting of the second terminal 22*a* in the second contact portion 42*a* and the fitting of the second terminal 22*b* in the second contact portion 42*b*, in other words, the entrance of the second terminal 22*a* into the terminal fitting groove 52*a* and the entrance of the second terminal 22*b* into the terminal fitting groove 52*b* are synchronized (occur at the same timing). In other words, the distance from the rotation start position of the second terminal 22*a* to the fitting start position of the second terminal 22*a* fitting in the terminal fitting groove 52*a* and the distance from the rotation start position of the second terminal 22*b* to the fitting start position of the second terminal 22*b* fitting in the terminal fitting groove 52*b* of the second terminal 22*b* are set to be equal to each other.

The peak of the above-mentioned rotation force acting on the male-side housing 1 occurs when the second terminals 22*a*, 22*b* enter the terminal fitting grooves 52*a*, 52*b* through the terminal fitting ports 56*a*, 56*b* and start to be fitted therein. Therefore, in the first embodiment, the peaks of the rotation force when the second terminal 22*a* enters the terminal fitting groove 52*a* (at the time of the start of the fitting) and when the second terminal 22*b* enters the terminal fitting groove 52*b* (at the time of the start of the fitting) coincide with each other, so that the necessary rotation force increases accordingly. For this reason, by shifting the entrance of the second terminal 22*a* into the terminal fitting groove 52*a* and the entrance of the second terminal 22*b* into the terminal fitting groove 52*b*, the peak of such a rotation force can be distributed, and as a result, the rotation force at the peak can be reduced. Hereinafter, a connector where the peak of the rotation force is distributed to thereby reduce the rotation force at the peak as described above will be described as a second embodiment. In the second embodiment, since the basic structures of the connector is similar to those of the first embodiment described above (FIGS. 1A to 2B), structures the same or similar to such structures are denoted by the same reference signs in the drawings and descriptions thereof are omitted. Therefore, structures particular to the second embodiment (FIGS. 3A and 3B) will be described in detail below.

Figure 3A:
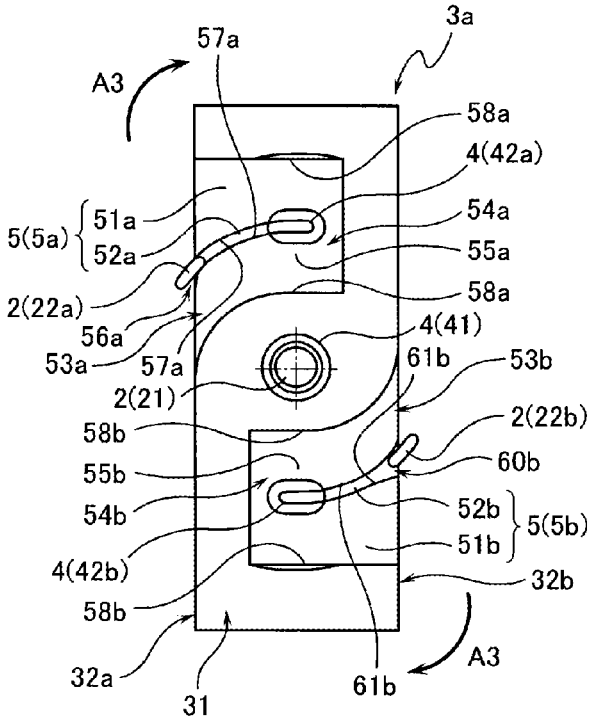
FIGS. 3A and 3B are views schematically showing a rotation of terminals (second terminals) when engaging a male-side housing and a female-side housing of a connector according to a second embodiment of the present invention, FIG. 3A being a schematic view showing a state at the time when one of the second terminal enters a terminal fitting groove (at the time of starting the fitting), and FIG. 3B being a schematic view showing a state at the time when the other second terminal enters a terminal fitting groove (at the time of starting the fitting).
Figure 3B:
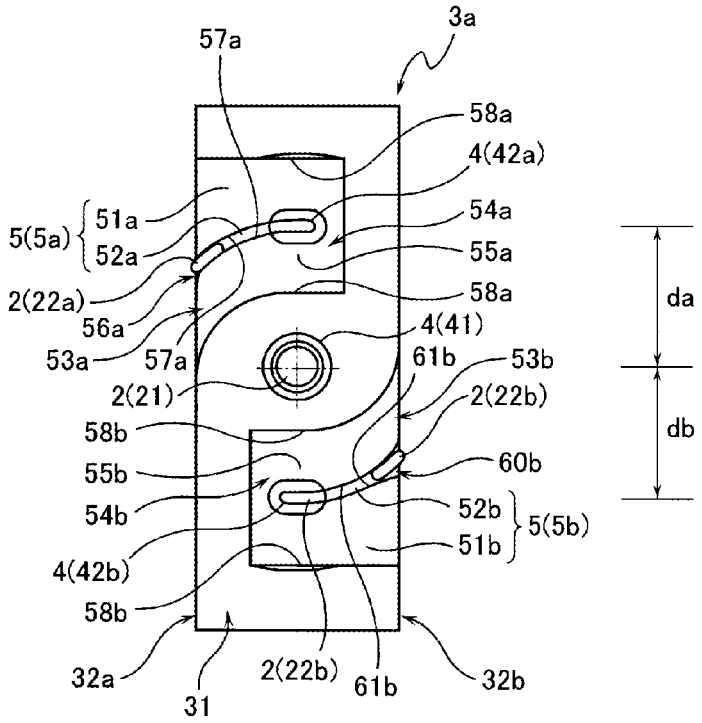

FIGS. 3A and 3B are views schematically showing a rotation of the second terminals 22*a*, 22*b* when the male-side housing and the female-side housing are engaged with each other in a connector according to the second embodiment of the present invention, FIG. 3A being a schematic view showing a state at the time when the second terminal 22*a* enters the terminal fitting groove 52*a* (at the time of the start of the fitting), and FIG. 3B being a schematic view showing a state at the time when the second terminal 22*b* enters the terminal fitting groove 52*b* (at the time of the start of the fitting).

In the present embodiment, the second terminals 22*a*, 22*b* are opposed to each other in a pair across the first terminal 21, and the fitting grooves 5*a*, 5*b* are formed so as in a pair corresponding to the pair of second terminals 22*a*, 22*b* (like in the first embodiment described above). The distance from the rotation start position of one of the two terminals 2 opposed to each other in a pair across the first terminal 21 to the fitting start position of the one of the two terminals 2 fitting in the fitting groove 5*a* and the distance from the rotation start position of the other terminal 2 to the fitting start position of the other terminal fitting in the fitting groove 5*b* are set to different from each other. In other words, the distance from the rotation start position of the second terminal 22*a* to the fitting start position of the second terminal 22*a* fitting in the terminal fitting groove 52*a* and the distance from the rotation start position of the second terminal 22*b* to the fitting start position of the second terminal 22*b* fitting in the terminal fitting groove 52*b* are different from each other.

In this case, as shown in FIGS. 3A and 3B, a terminal fitting port 60*b* of the terminal fitting groove 52*b* is larger than the terminal fitting port 56*a* of the terminal fitting groove 52*a*, in other words, is opened more largely than the second terminal 22*b*. As an example, the terminal fitting port 60*b* has a structure where a groove wall 61*b* is inclined while gradually becoming closer so as to be tapered from the opened part of the side surface 32*b* of a female-side housing 3*a* toward the terminal fitting groove 52*b*. Such a tapered part may be structured so as to be situated so that the terminal fitting port 60*b* is the starting point and a given position on the terminal fitting groove 52*b* on the way to the second contact portion 42*b* is the ending point. While a structure where the neighborhood of the terminal fitting port 60*b* of the terminal fitting groove 52*b* is tapered is shown in FIGS. 3A and 3B, for example, a structure may be assumed where the terminal fitting groove 52*b* is tapered from the terminal fitting port 60*b* to the second contact portion 42*b*. The terminal fitting port 56*a* of the terminal fitting groove 52*a* is formed so as to be curved in an arc shape slightly larger (the outside diameter is large and the inside diameter is small) than the second terminal 22*a* as in the above-described first embodiment (FIGS. 1 and 2).

Therefore, in the present embodiment, when the male-side housing 1 and the female-side housing 3*a* are rotated relative to each other and engaged with each other and the terminals 2 (the first terminal 21 and the second terminals 22*a*, 22*b*) and the contact portions 4 (the first contact portion 41 and the second contact portions 42*a*, 42*b*) are brought into contact with each other to be electrically connected, from the rotation start position (the position immediately before the male-side housing 1 and the female-side housing 3*a* are rotated relative to each other) to the fitting start position into the terminal fitting grooves 52*a*, 52*b* (the position immediately after the occurrence of drag against the terminals 2) of the second terminals 22*a*, 22*b* is as follows.

As an example, following is a situation in which force that rotates the second terminals 22*a*, 22*b* in the direction A3 shown in FIG. 3A (hereinafter, rotation force) is applied to the male-side housing 1, and the male-side housing 1 is rotated with respect to the female-side housing 3*a*. First, the second terminal 22*a* enters the terminal fitting groove 52*a* through the terminal fitting port 56*a* and starts to be fitted into the terminal fitting groove 52*a* (the condition shown in FIG. 3A). On the other hand, at the time of the start of the fitting of the second terminal 22*a* into the terminal fitting groove 52*a*, the second terminal 22*b* has not started to be fitted into the terminal fitting groove 52*a* although it has entered the terminal fitting port 60*b* (the condition shown in FIG. 3A). Therefore, under this condition, although the rotation force for rotating the second terminal 22*a* is at its peak, the rotation force for rotating the second terminal 22*b* is not at its peak.

By further applying the rotation force under this condition, the second terminal 22*b* starts to be fitted into the terminal fitting groove 52*b* (the condition shown in FIG. 3B). On the other hand, the second terminal 22*a* is fitted in the terminal fitting groove 52*a* while sliding on the groove wall 57*a*. Therefore, under this condition, although the rotation force for rotating the second terminal 22*b* is at its peak, the rotation force for rotating the second terminal 22*a* is not at its peak.

As described above, the time of the entrance (the start time of the fitting) of the second terminal 22*a* into the terminal fitting groove 52*a* and the time of the entrance (the start time of the fitting) of the second terminal 22*b* into the terminal fitting groove 52*b* can be shifted. In other words, the time of the entrance (the time of the start of the fitting) of the second terminal 22*a* into the terminal fitting groove 52*a* and the time of the entrance (the time of the start of the fitting) of the second terminal 22*b* into the terminal fitting groove 52*b* never coincide with each other. For this reason, the peak of the rotation force can be distributed. As a result, the rotation force at the peak can be reduced.

The procedure itself performed when the male-side housing 1 and the female-side housing 3*a* are rotated relative to each other and engaged with each other and the terminals 2 (the first terminal 21 and the second terminals 22*a*, 22*b*) and the contact portions 4 (the first contact portion 41 and the second contact portions 42*a*, 42*b*) are brought into contact with each other to be electrically connected is similar to that in the case of the above-described first embodiment. Moreover, it is also similar that the electrical connection between the second terminals 22*a*, 22*b* and the second contact portions 42*a*, 42*b* can be shut off by performing predetermined work by a procedure opposite to that at the time of connection.

According to the first embodiment (FIGS. 1A to 2B) and the second embodiment (FIGS. 3A and 3B) of the present invention, only by relatively rotating the male-side housing 1 and the female-side housing 3 so as to be engaged with each other, the terminals 2 (the first terminal 21 and the second terminals 22*a*, 22*b*) and the contact portions 4 (the first contact portion 41 and the second contact portions 42*a*, 42*b*) are brought into contact with each other, so that the terminals 2 and the contact portions 4 can be electrically connected. Consequently, the force to be applied for connecting the terminals 2 and the contact portions 4 can be reduced. Moreover, in connecting the terminals 2 and the contact portions 4, for example, fastening work using bolts and nuts is unnecessary, the work process is not increased, and it is also unnecessary to provide an opening or the like for inserting a work tool or the like into the connector. For this reason, it is not required to increase the physical size of the connector, so that downsizing can be achieved. As described above, with the connector according to the present invention, the workload for connecting the terminals 2 (the first terminal 21 and the second terminals 22*a*, 22*b*) and the contact portions 4 (the first contact portion 41 and the second contact portions 42*a*, 42*b*) can be reduced while downsizing its body.

Now, features of the connectors according to the embodiments of the present invention described above are briefly summarized and listed in the following [1] to [4].

[1] A connector having a male-side housing (1) provided with terminals (2), and a female-side housing (3) provided with contact portions (4) to contact the terminals. In a state in which the male-side housing and the female-side housing are rotated relative to each other and engaged with each other, the terminal and the contact portion are in contact with each other to be electrically connected. The terminals include a first terminal (21) and a second terminal (22*a*, 22*b*), the first terminal being provided to protrude toward the contact portion as a rotation axis of the relative rotation of the male-side housing and the female-side housing. The contact portions include a first contact portion (41) into which the first terminal is inserted in a rotatable manner and a second contact portion (42*a*, 42*b*) in which the second terminal is fitted. The female-side housing is formed with a fitting groove (52*a*, 52*b*) configured to guide the second terminal to rotate about the first terminal during the rotation relative to the male-side housing and to fit the second terminal in the second contact portion.

[2] The contact according to [1], in which two of the second terminals and two of the second contact portions are provided.

[3] The connector according to [2], in which distances (da, db) from a center axis of the first terminal to the second terminals are different from each other.

[4] The connector according to [2] or [3], in which the second terminals are opposed to each other in a pair across the first terminal. The fitting grooves are formed in a pair corresponding to the pair of second terminals. A distance from a rotation start position of one the second terminals to a fitting start position of the one the second terminals fitting in one of the fitting grooves and a distance from a rotation start position of the other fitting groove to a fitting start position of the other fitting groove fitting in the other fitting groove are different from each other.

While the present invention has been described in detail with reference to specific embodiments, those skill in the art will understand that various changes and modifications can be made therein without departing from the spirit and scope of the present invention.

What is claimed is:

1. An electrical connector comprising:

a male-side housing provided with terminals; and a female-side housing provided with contact portions to contact the terminals, wherein the terminals and the contact portions electrically connect and contact to each other in a state in which the male-side housing and the female-side housing are rotated relative to each other and engaged with each other, wherein the terminals comprise a first terminal and second terminals, the first terminal being provided to protrude outwardly from the male-side housing toward the contact portion and being as a rotation axis of the relative rotation of the male-side housing and the female-side housing, wherein the contact portions comprise a first contact portion having a hole into which the first terminal is inserted in a rotatable manner and second contact portions in which the second terminals are fitted in and contact, and wherein the female-side housing is formed with a pair of fitting grooves that open at opposing side edge surfaces of the female-side housing, the fitting grooves being configured to guide the second terminals to rotate about the first terminal during the rotation relative to the male-side housing and to fit the second terminals in the second contact portions.

2. The electrical connector according to claim 1, wherein distances from a center axis of the first terminal to the second terminals are different from each other.

3. The electrical connector according to claim 1, wherein the second terminals are opposed to each other in a pair across the first terminal, wherein the fitting grooves are formed in a pair corresponding to the pair of second terminals, and wherein a distance from a rotation start position of one of the second terminals to a fitting start position of the one of the second terminals fitting in one of the fitting grooves and a distance from a rotation start position of the other second terminals to a fitting start position of the other second terminal fitting in the other fitting groove are different from each other.

4. The electrical connector according to claim 1, wherein the male-side housing comprises a pair of base portions which protrude from a flat surface of the male-side housing, wherein the second terminals protrude from the base portions of the male-side housing, and wherein the fitting grooves of the female-side housing comprise pedestal fitting grooves configured to receive the base portions as the second terminals rotate about the first terminal.

5. The electrical connector according to claim 1, wherein the second terminals and the fitting grooves are both shaped as an arc having a radius defined by a center axis of the first terminal to the second terminals.

* * * * *